United States Patent [19]

Coons

[11] Patent Number: 4,872,678

[45] Date of Patent: Oct. 10, 1989

[54] PRESSURIZABLE GAME BALL

[76] Inventor: Gex B. Coons, 506 Amber Dr., Huntington Beach, Calif. 92648

[21] Appl. No.: 255,593

[22] Filed: Oct. 11, 1988

[51] Int. Cl.[4] ..... A63B 39/04; A63B 41/00

[52] U.S. Cl. ..... 273/61 R; 273/61 D; 273/65 D; 137/844

[58] Field of Search ..... 137/852, 860, 844; 273/61 R, 61 D, 65 R, 65 C, 65 D, 65 ED, 65 EE, 58 B, 58 BA

[56] References Cited

U.S. PATENT DOCUMENTS 2,009,237 7/1935 McGall ..... 273/65 D 4,070,434 1/1978 Noda ..... 273/61 D

*Primary Examiner*—George J. Marlo

*Attorney, Agent, or Firm*—Roy A. Ekstrand

[57] ABSTRACT

A pressurizable game ball and valve includes a hollow spherical game ball formed of a rubber material or the like defining a pair of shell halves bonded together to form a spherical ball. An aperture extends through the shell half surface and an annular flexible disk valve is secured to the interior portion of the shell half overlying the aperture. The disk valve responds to the pressure differential between the ball interior and the ball exterior to communicate pressurized air into the game ball for pressurization and to maintain a sealing contact over the aperture during normal use.

7 Claims, 1 Drawing Sheet

PRESSURIZABLE GAME BALL

FIELD OF THE INVENTION

This invention relates generally to game balls and particularly to those having a pressurized gas center and resilient outer shell.

BACKGROUND OF THE INVENTION

Through the years a number of game balls have been developed and used in sports and amusement activities. While certain game balls are formed of a solid rubber sphere or the like, a great number of sport or game balls are formed of an elastic or resilient outer spherical shell within which a closed interior cavity confines a volume of pressurized gas such as air or the like. In accordance with the need in most sports activities to provide a substantial rebound or bounce characteristic, the pressure of the captivated gas within the game ball interior generally exceeds atmospheric pressure by a substantial amount.

The size and shape of such game or sport balls varies substantially. For example, in the sports of basketball, soccer and the like, the game ball comprises a relatively large sphere which is subject to very rigid standards of weight, size, pressurization and bounce characteristics. In further variance, the sport of American football uses an oblong ball having pointed ends while sports such as tennis and racquetball employ relatively small spherical game balls having extremely high bounce characteristics. Regardless of the substantial variety of sizes and shapes of game balls, all pressurized playing balls are subject to a common problem which is generally described as leakage. The leakage problem is simply the characteristic by which small amounts of the pressurizing gas within the ball escape leaving the ball with a reduced undesirable and sometimes unacceptable bounce characteristic.

In general, the larger game or sport balls, such as those used in basketball, soccer or American football, have for many years utilized a pressurizing valve within the ball structure and the inflation of the sport ball is a routine practice. In most instances, the larger mass of the large sport balls masks any unbalancing effect provided by the weight of the pressurizing valve. As a result, the leakage characteristic of such larger sport balls has not heretofore been found to be a serious problem.

In smaller game or sport balls such as bladderless tennis and racquetball, however, the leakage problem has been found to be more serious. In general, such smaller game or sport balls are manufactured without a pressurizing valve and are formed of a elastic shell under high pressure conditions which initially pressurizes the ball. During the course of the use of the game or sport ball and with the passage of time during extended periods of nonuse, the captivated pressurized gas within the ball interior usually diffuses through the minute pores of the shell material. While substantial efforts are exercised to maintain a low porosity of the ball skin, virtually all elastic shell materials found to date are sufficiently porous to permit slow leakage. In addition, the game activities to which the smaller sport or game balls such as tennis and racquetball are subjected, provide for repeated and frequent hard impacts against the players' racquets and the surrounding playing court surfaces. The combined effect of these conditions is to cause leakage of the game ball and a change in the bounce characteristic of the ball. Since even small changes of bounce characteristic provide unacceptable performance for the game ball in sports such as tennis and racquetball, such balls must be either repressurized or discarded.

The need to repressurize the smaller game or sport balls or to maintain the pressurization of such balls between use has led practitioners in the art to devise various pressurized containers to be used in storing the smaller sport or game balls. While the structures of such devices vary substantially, all provide the common operative element of an interior cavity together with means for supporting one or more such smaller sport or game balls in a pressurized environment. The operative mechanism of such pressurized storage containers is simply to subject the ball to a pressurized environment substantially greater than the pressure within a game ball having suffered some loss. The same porosity which in normal use and storage provides for a slow diffusion of the pressurized interior gas through the outer shell, also permits a similar slow diffusion inwardly through the outer shell from the pressurized storage environment to the ball interior. After an extended period of time, the game or sport balls are returned to the desired pressure and may be used. While this process prolongs the life of game or sport balls and permits repeated pressurization of the game or sport balls, it requires a considerable storage time to achieve the desired effect.

Because of the desire to circumvent the substantial storage time required to repressurize a game ball in such pressure storage containers, practitioners in the art have made several attempts to provide a valve mechanism for use in the smaller game balls. One such attempt is found in U.S. Pat. No. 2,830,610 issued to Chupa for a VALVE FOR PLAY BALLS in which a playing ball defines a resilient outer shell having an aperture therethrough which provides access to the ball interior. A valve mechanism defines a generally conical projection extending through the aperture and into the ball interior. The valve structure further includes an extending flange on its outer surface which is attached to the exterior surface of the ball shell around the aperture in a sealing attachment. The valve defines an interior passage which receives the needle portion of a conventional ball inflating device.

U.S. Pat. No. 4,012,041 issued to Hoffman sets forth a GAME BALL REPRESSURIZING METHOD in which a game ball is provided with an inwardly extending generally cone-shaped valve member which may be separately manufactured and inserted into an aperture in the game ball shell or which may be integrally molded into the game ball outer shell. The valve member includes a pair of thin flanges or lips arranged side by side which allow air to pass freely into the ball when the pressure outside the valve is greater than the pressure inside the valve but which sealingly close when the pressure inside the ball exceeds the external pressure. A cooperating inflating device configured to operate the valve is shown which may be utilized to repressurize the game ball.

While the provision of a game or sport ball of the smaller variety having a pressurizing valve is generally desirable, the valves provided to date have been subject to several problems. One problem arises out of the extra weight provided by the valve mechanism itself. Because the valve weight is substantial in comparison to the surrounding shell material of the ball, the concentration of mass imposed on the ball by the pressurizing valve tends to unbalance the ball. In addition, such valve structures have been found themselves to be susceptible to leakage over time and is effected by the striking of the ball near the valve region. Finally, the use of such valve mechanisms can be costly and increase the expense of ball manufacture.

As a result, there arises a need in the art for a pressurizable game ball and pressurizing valve which is maintained in closure by a mechanical advantage and which provides a low cost reliable valve mechanism and which does not simultaneously unbalance the ball.

SUMMARY OF THE INVENTION

Accordingly, it is a general object of the present invention to provide an improved game ball. It is a more particular object of the present invention to provide an improved game ball which may be repressurized. It is a still more particular object of the present invention to provide an improved pressurizing valve for operation within a game ball.

In accordance with the present invention, there is provided a pressurizable game ball comprising a closed ball surface defining an interior cavity, an interior surface, and a wall aperture therethrough; and a valve member having a flexible raised portion defining a valve aperture and an attachment surface extending therefrom. The attachment surface is conformable to and attachable to the interior surface such that the raised portion overlies the wall aperture.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
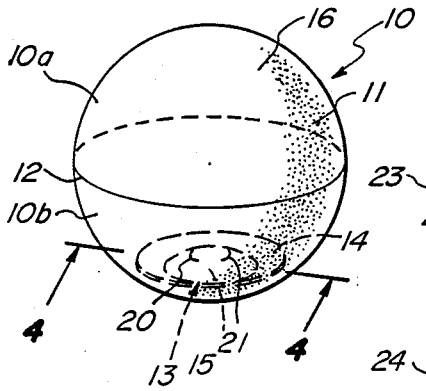
FIG. 1 is a perspective view of a game ball constructed in accordance with the present invention.

FIG. 1 sets forth a perspective view of a game ball 10 constructed in accordance with the present invention. Ball 10 includes a resilient or elastic outer shell 11 preferably formed of an elastic material such as rubber or the like which encloses a ball interior cavity 16. In accordance with conventional fabrication techniques, outer shell 11 includes a pair of matching shell halves 10*a* and 10*b* joined at a seam 12. As is set forth below in greater detail, a valve 13 constructed in accordance with the present invention includes a generally annular lip portion 14 and a valve dome 15. Dome 15 defines a pair of valve slits 20 and 21. As is better seen below in FIG. 4, lip 14 is sealingly attached to the interior surface of shell half 10*b*.

Figure 2:
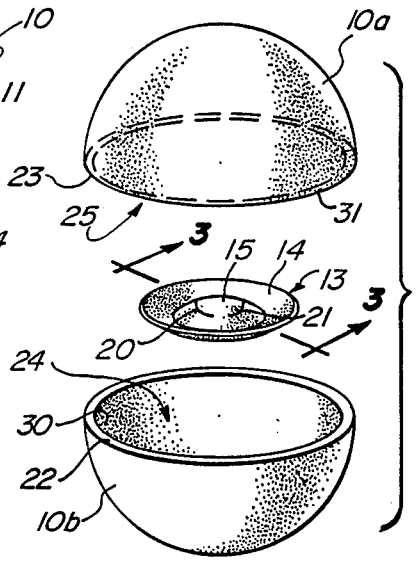
FIG. 2 is an assembly view of the present invention game ball and valve therefor.

FIG. 2 sets forth an assembly view of ball 10 in which shell halves 10*a* and 10*b* are separated prior to assembly. Shell half 10*a* defines an interior surface 31 surrounding a semispherical interior cavity 25 and an edge portion 23. Correspondingly, shell half 10*b* defines an interior surface 30, an interior cavity 24, and an edge portion 22. In addition, while not seen in FIG. 2, shell half 10*b* further defines an aperture 35 (seen in FIG. 4) which extends through shell half 10*b*.

A valve 13 includes an annular lip 14 and a valve dome 15. In accordance with an important aspect of the present invention, lip 14 and valve dome 15 are formed of a continuous thin disk of elastic material shaped in the manner shown in FIG. 2. Dome 15 further defines a center 17 and a pair of valve slits 20 and 21 which in accordance with an important aspect of the present invention define concentric arc portions about center 17 of dome 15.

Ball 10 is assembled by initially placing valve 13 within interior cavity 24 of shell half 10*b* such that lip 14 rests against interior surface 30 of shell half 10*b*. Valve 13 is positioned such that center 17 of dome 15 is directly above aperture 35 in shell half 10*b* (seen in FIG. 4). Thereafter, valve 13 is secured to interior surface 30 by bonding lip 14 thereto. While any of several attachment methods may be used to secure lip 14 to interior surface 30, in the preferred method a vulcanizing process is used in which lip 14 is partially cured and in which the corresponding underlying portion of interior surface 30 is also partially cured. In accordance with conventional vulcanizing techniques, a layer of uncured rubber is coated upon lip 14 and thereafter lip 14 and interior surface 30 are cured to provide a sealing permanent bond therebetween. Similarly, shell half 10*a* defines an edge portion 23 which is partially cured and shell half 10*b* defines an edge 22 which is also partially cured. The assembly of shell halves 10*a* and 10*b* is, in accordance with conventional fabrication techniques, carried forward by interposing a small amount of uncured rubber between edges 22 and 23 and following assembly of shell halves 10*a* and 10*b*. Thereafter, the curing process is carried forward to vulcanize edges 22 and 23 in a sealing attachment to form seam 12 (seen in FIG. 1).

Figure 3:
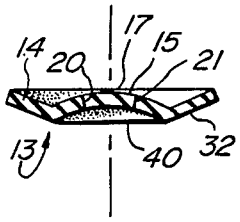
FIG. 3 is a section view of the valve portion of the present invention taken along section lines 3–3 in FIG. 2.

FIG. 3 sets forth a section view of valve 13 taken along section lines 3–3 in FIG. 2. Valve 13, as described above, is fabricated from a thin flexible rubber disk and is formed to define an annular lip portion 14 having a generally cone-shaped surface 32 which as described below generally conforms to the curvature of interior surface 30 of shell half 10*b* (seen in FIG. 4). Valve 13 further defines an upwardly curving spherical dome portion 15 continuously joined to lip 14 at an edge 40. In accordance with an important aspect of the present invention, valve dome 15 defines a pair of valve slits 20 and 21 on either side of dome center 17 which define arc portions mutually concentric with dome center 17. It will be apparent to those skilled in the art by examination of FIG. 3 that valve 13 may be readily formed and fabricated using conventional rubber molding and processing techniques. It should be further apparent to those skilled in the art that valve 13 may be manufactured of relatively low cost material and requires no additional processing other than its fabrication in the form shown in FIG. 3.

Figure 4:
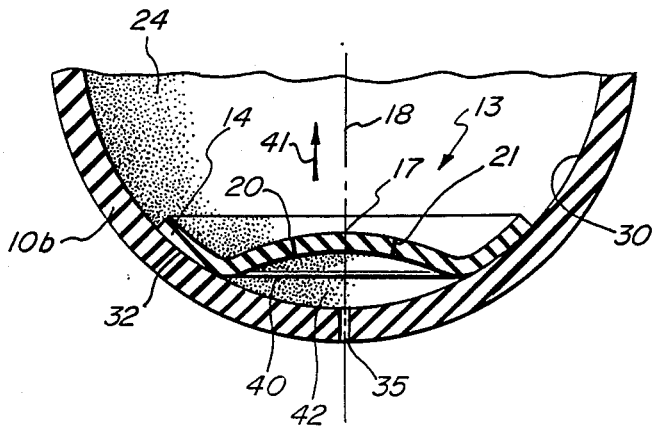
FIG. 4 is a partial section view of the present invention game ball taken along section lines 4–4 in FIG. 1.

FIG. 4 sets forth a partial section view of the present invention pressurized game ball and valve taken along section lines 4–4 in FIG. 1. Shell half 10*b* defines a spherical rubber wall defining an interior cavity 24 and an aperture 35 extending therethrough. Shell half 10*b* further defines an interior surface 30 and an aperture 35. Valve 13 is formed of a thin rubber disk as described above which defines an annular lip portion 14 having a generally cone-shaped surface 32 and a spherical valve dome 15. Valve dome 15 and lip 14 are continuously joined at an edge 40. Valve dome 15 further defines a pair of valve slits 20 and 21 concentrically positioned with respect to valve dome center 17. In accordance with the preferred fabrication of the present invention, valve 13 is positioned upon interior surface 30 such that valve center 17 is in alignment with center line 18 of aperture 35 in shell half 10*b*. In accordance with conventional fabrication techniques such as the above-mentioned vulcanizing process, surface 32 of lip 14 is bonded to the underlying portion of interior surface 30 of shell half 10*b*. As mentioned above, surface 32 of lip 14 is generally cone-shaped and, because lip 14 is formed of a resilient flexible material, surface 32 readily conforms to the curvature of interior surface 30 of shell half 10*b*. Thus, a gas-tight sealing attachment is created in which lip 14 literally becomes part of shell half 10*b*. In the position shown in FIG. 4, the pressure within interior cavity 24 is approximately equal to the exterior pressure about ball 10. As a result, valve 13 assumes the position shown in FIG. 4. The sealing attachment of lip 14 to interior surface 30 forms a cavity 42 between valve dome 15 and the underlying portion of interior surface 30. In accordance with an important aspect of the present invention, the radius of curvature of valve dome 15 is smaller than the radius of curvature of shell half 10*b*. The importance of this difference in radius of curvature is described below in greater detail. However, suffice it to note here that this radius difference results in compression of valve dome 15 in order to conform valve dome 15 to the underlying surface of interior surface 30 as shown in FIG. 6*c*. Aperture 35 communicates cavity 42 with the surrounding pressure of ball 10 which in turn results in subjecting valve dome 15 to the pressure difference between interior cavity 24 and the surrounding pressure environment of ball 10. As mentioned above, the configuration of valve 13 shown in FIG. 4 corresponds to the situation in which the pressure within interior cavity 24 generally corresponds to the surrounding pressure of the environment of ball 10.

Figure 6A:
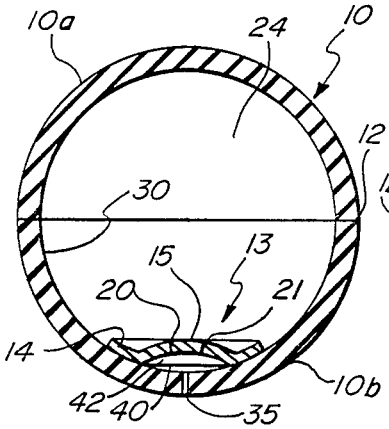
FIG. 6*a*, 6*b*, and 6*c* set forth sequential section views of the present invention pressurizable game ball and valve.
Figure 6B:
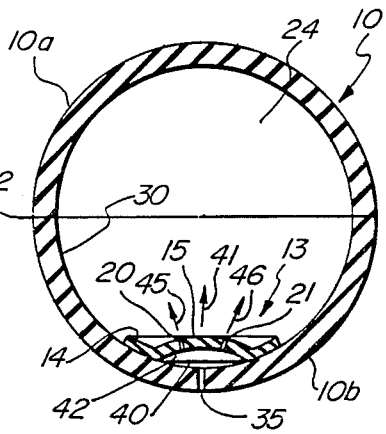
Figure 6C:
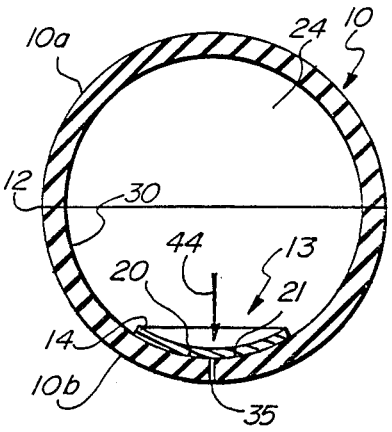

FIGS. 6*a*, 6*b* and 6*c* set forth the positions of valve 13 within shell half 10*b* of ball 10 which result from various pressure relationships between interior cavity 24 of ball 10 and its surrounding environment. Specifically, FIG. 6*a* sets forth the response of valve 13 to equal pressures within interior cavity 24 and the surrounding environment of ball 10. As seen in FIG. 6*a*, shell halves 10*a* and 10*b* are joined in accordance with the above-described vulcanizing process or its equivalent to form a seam 12 and define a continuous spherical game ball. Aperture 35 extends through shell half 10*b*. Valve 13 is secured by the bonding of lip 14 to interior surface 30 of shell half 10*b* such that valve dome 15 is centered above aperture 35 as shown in FIG. 4. As is also mentioned above, valve dome 15 defines a pair of concentric valve slits 20 and 21. Valve dome 15 and the underlying portion of surface 30 of shell half 10*b* define a cavity 42 which is in communication with the exterior of ball 10 via aperture 35. As mentioned, FIG. 6*a* sets forth the circumstance in which the pressure within interior cavity 24 is approximately the same as the exterior pressure upon ball 10. As a result, the pressure on either side of valve dome 15, that is within interior cavity 24 and cavity 42, is approximately equal. With equal pressures on either side of valve dome 15, very little if any force is applied to the valve dome and valve 13 remains in the position shown.

FIG. 6*b* sets forth the circumstance in which the pressure surrounding ball 10 is increased substantially beyond the pressure within interior cavity 24. As mentioned, aperture 35 assures that the pressure within cavity 42 corresponds to the pressure of the environment surrounding ball 10. As a result, the greater pressure within cavity 42 produces an imbalance of forces upon valve dome 15 causing it to be expanded inwardly within interior cavity 24 in the direction indicated by arrow 41. It should be noted that the higher pressure within cavity 42 upon valve dome 15 causes a generally radial expansion or stretching of valve dome 15. As valve dome 15 is radially stretched inwardly, valve slits 20 and 21 are opened in the manner indicated in FIG. 6*b*. The opening of valve slits 20 and 21 provides a pair of apertures through which the pressurized gas within cavity 42 is caused to flow into interior cavity 24 of ball 10 in the direction indicated by arrows 45 and 46. Valve dome 15 remains in the stretch position shown in FIG. 6*b* so long as the pressure within cavity 42 substantially exceeds the pressure within interior cavity 24. As a result of this pressure difference, the gas within cavity 42 continues to flow through valve slits 20 and 21 until the pressure within interior cavity 24 substantially equals the surrounding pressure upon ball 10. Once the pressure within ball 10 is approximately equal to the surrounding pressure, the stretching forces upon valve dome 15 are relaxed and valve 13 assumes the position shown in FIG. 6*a*.

FIG. 6*c* sets forth the position of valve 13 within ball 10 which result when the pressure within interior cavity 24 is substantially greater than the surrounding pressure upon ball 10. As can be seen, the effect of the greater pressure within interior cavity 24 causes dome 15 of valve 13 to be forced outwardly against interior surface 30 of shell half 10*b*. The outward force exerted upon valve dome 15 causes the gas within cavity 42 (see FIG. 6*a*) to be forced outwardly through aperture 35. Valve dome 15 is thereafter forced against interior surface 30 of shell half 10*b* causing the center portion of valve dome 15 to overlie aperture 35. The flexible character of valve 13 permits valve dome 15 to conform to the portion of interior surface 30 surrounding aperture 35 in a sealing contact. In addition, the force exerted against valve dome 15 in the direction indicated by arrow 44 by the greater pressure within interior cavity 24 forces the curved portion of valve dome 15 to conform to the underlying portion of interior surface 30. As mentioned above and in accordance with an important aspect of the present invention, the radius of curvature of valve dome 15 is smaller than the radius of curvature of interior surface 30. As a result, valve dome 15 is subjected to a edgewise compressive force as it is "squeezed" into the closed position shown in FIG. 6. The compressive force in turn forces valve slits 20 and 21 to the closed position shown in FIG. 6*c* and exerts a positive sealing force against the valve slits which further seals interior cavity 24 from the exterior of ball 10. It should be noted that the flexibility of valve 13 permits the present invention valve to maintain its conformity to interior surface 30 of shell half 10*b* during deformation of shell half 10*b* which normally occurs during the use of game ball 10 as it rebounds from impacting surfaces. It will be apparent by sequential examination of FIGS. 6*a*, 6*b* and 6*c* that game ball 10 may be pressurized from the circumstances in FIG. 6*a* in which interior cavity 24 is generally equal to the surrounding pressure by simply placing game ball 10 in a pressurized environment. The placement of game ball 10 in a pressurized environment causes the flow of pressurizing gases through valve 13 shown in FIG. 6*b* after which the removal of ball 10 from the pressurized environment causes the closure of valve 13 shown in FIG. 6*c* which maintains the increased pressure within interior cavity 24. It should be further noted that game ball 10 need not be fully depressurized as shown in FIG. 6*a* to operate the present invention valve. It should be apparent that an already existing high pressure within interior cavity 24 which configures the present invention valve in the manner shown in FIG. 6*c* can be further increased by placing game ball 10 in a still higher pressure environment. Notwithstanding the sealing configuration of valve 13 shown in FIG. 6*c* under pressurized conditions within interior cavity 24, valve 13 assumes the position shown in FIG. 6*b* whenever the surrounding pressure exceeds the pressure within interior cavity 24 allowing still greater pressurization of game ball 10. Thus, game ball 10 may be further pressurized to compensate for small losses of pressure within interior cavity 24.

Figure 5:
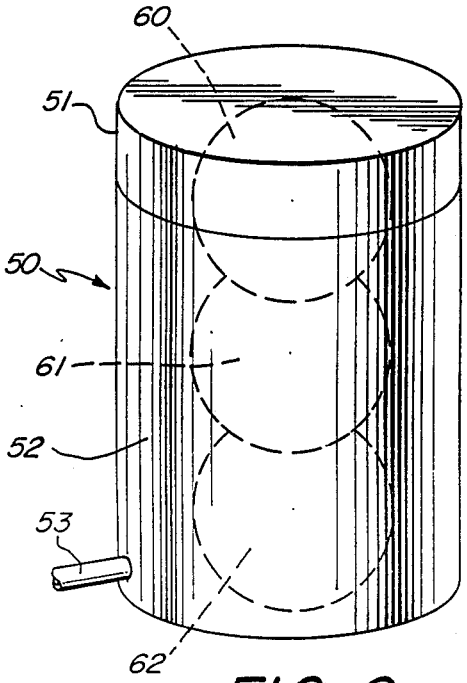
FIG. 5 is a perspective view of a pressurizing device supporting a plurality of the present invention game balls.

FIG. 5 sets forth a typical pressurizing environment for game balls in which a pressure vessel 50 defines an interior cavity supporting a plurality of game balls 60, 61 and 62. A removable cap 51 is secured to pressure vessel 50 in a sealing engagement. A pressure line 53 is coupled to a source of pressurized gas (not shown). Game balls 60, 61 and 62 are constructed in accordance with the present invention and are placed within pressure vessel 50 with cap 51 secured. Thereafter, the pressurized gas is coupled to the interior 52 of pressure vessel 50 by pressure line 53 which increases the pressure surrounding game balls 60, 61 and 62 and maintains this increased pressure. In accordance with the invention, each of game balls 60, 61 and 62 includes the present invention valve which responds in the above-described manner to the difference between the interior pressure of the game ball and the pressure within pressure vessel 50. Because the present invention valve within each of game balls 60, 61 and 62 operates quickly to equalize the pressures within the game balls to the surrounding environment, game balls 60, 61 and 62 need only be maintained within pressure vessel 50 for a very brief time to restore the ball pressurization and permit use of the game balls in play.

It should be noted that in conventional fabrication of pressurized game balls of the type shown in FIGS. 1 through 6, the need to pressurize the ball interior is usually met by carrying out the final assembly of the game balls in pressurized environments to captivate the pressurized gas within the ball or using the off gassing pellets. While the present invention game ball may be manufactured in accordance with either of the existing processes, the novel structure of the present invention game ball and valve permits the ball to be manufactured without the use of pressurizing environments or off gassing pellets and suitably pressurized by subjecting the game ball to a pressurized environment following the ball manufacturer. In either case, the resulting game ball is, in accordance with the invention, readily and easily repressurized to maintain its bounce characteristics and extend its useful life beyond conventional game balls.

It should be further apparent to those skilled in the art that while the present invention valve shown herein is utilized to provide the ready repressurization of a game ball, its use is not limited to the game ball environment. It is anticipated that the pressurizing valve of the present invention may readily be used in any number of environments without departing from the spirit and scope of the present invention.

It has been found that for most ball structures and internal gas pressures, the present invention valve disk may be made thin enough and light enough to have virtually no effect upon the dynamic balance of the game ball. However, in the event imbalance results, a compensating mass may be molded within or attached within the game ball interior opposite the valve location.

What has been shown is a pressurizable game ball and valve which is easy and inexpensive to manufacture and which provides for the rapid repressurization of a game ball without substantially disturbing the balance or play characteristics of the ball.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A pressurizable bladderless game ball comprising:

a closed ball surface defining an interior cavity, an interior surface, and a wall aperture therethrough; and a valve member having a flexible raised portion defining a valve aperture and an attachment surface extending therefrom, said attachment surface being conformable to and attachable to said interior surface such that said raised portion overlies said wall aperture.

2. A pressurizable game ball as set forth in claim 1 wherein said valve member defines a flexible disk and wherein said raised portion defines a dome shaped portion.

3. A pressurizable game ball as set forth in claim 2 wherein said interior surface defines a first radius of curvature and wherein said dome shaped portion defines a second radius of curvature less than said first radius of curvature.

4. A pressurizable game ball as set forth in claim 3 wherein said valve aperture defines a first elongated slit.

5. A pressurizable game ball as set forth in claim 4 wherein said dome shaped portion defines a center and wherein said valve member is positioned upon said interior surface such that said center overlies said wall aperture.

6. A pressurizable game ball as set forth in claim 5 wherein said first elongated slit defines a first arc having a first arc radius center coincident with said center of said dome shaped portion.

7. A pressurizable game ball as set forth in claim 6 further including a second elongated slit defining a second arc having a second arc radius center coincident with said center of said dome shaped member.

* * * * *